US008850781B2

(12) United States Patent
Harvey et al.

(10) Patent No.: US 8,850,781 B2
(45) Date of Patent: Oct. 7, 2014

(54) WESTERN SAFETY STIRRUP

(76) Inventors: Timothy J. Harvey, Campton, NH (US); Robert Oaks, Campton, NH (US)

( * ) Notice: Subject to any disclaimer, the term of this patent is extended or adjusted under 35 U.S.C. 154(b) by 212 days.

(21) Appl. No.: 13/590,314

(22) Filed: Aug. 21, 2012

(65) Prior Publication Data

US 2014/0053516 A1 Feb. 27, 2014

(51) Int. Cl.
*B68C 3/02* (2006.01)
*B68C 3/00* (2006.01)

(52) U.S. Cl.
CPC .... *B68C 3/00* (2013.01); *B68C 3/02* (2013.01)
USPC ..... 54/49; 54/47

(58) Field of Classification Search
USPC ..... 54/49, 47, 48
IPC ..... B68C 3/00,3/02
See application file for complete search history.

(56) References Cited

U.S. PATENT DOCUMENTS

| | | | | | |
|---|---|---|---|---|---|
| RE1,759 | E | * | 9/1864 | Eagle | 54/47 |
| 259,101 | A | * | 6/1882 | Cox | 54/49 |
| 478,633 | A | | 7/1892 | Peacock | |
| 1,758,930 | A | * | 5/1930 | Archibald | 54/47 |
| 3,157,977 | A | * | 11/1964 | Kitchingham, Jr. | 54/49 |
| 5,058,366 | A | * | 10/1991 | McCoy | 54/49 |
| 6,629,405 | B2 | * | 10/2003 | Johnson | 54/48 |
| 2005/0076620 | A1 | * | 4/2005 | Sjosward | 54/48 |
| 2010/0300050 | A1 | * | 12/2010 | Vollmecke et al. | 54/47 |

* cited by examiner

*Primary Examiner* — Son T Nguyen
*Assistant Examiner* — Kathleen Alker
(74) *Attorney, Agent, or Firm* — Daniel S. Coolidge

(57) ABSTRACT

A western safety stirrup is disclosed having an elastic band forming the outer side of the portion of the stirrup wherein a boot is to be placed, held at top and bottom by studs. The upper stud is recessed below the outer side of the stirrup so as not to catch on clothing or brush. The lower stud has a flattened head and protrudes at an angle downwardly, and is attached to the elastic band by means of a leather wrap having holes in each end to place over the lower stud. When outward pressure is placed on the elastic band, it pops off and the boot is released from the stirrup. A leather keeper flap over the band attached at its upper end allows for the elastic to break away while protecting against snagging and provides a more western aesthetic appearance to the stirrup.

10 Claims, 6 Drawing Sheets

WESTERN SAFETY STIRRUP

TECHNICAL FIELD

The present invention relates to equestrian equipment, and more particularly relates to Western style riding tack.

BACKGROUND INFORMATION

One of the serious dangers associated with horseback riding is the risk of falling and getting a boot caught in a stirrup. English style riders have long had the advantage of several designs of safety stirrup, most famously the Peacock Stirrup (U.S. Pat. No. 478,633, issued in 1892). The Peacock stirrup has outer side replaced by an elastic band with loop on either end. The loops fit over studs at the top and bottom respectively of the outer side of the stirrup, such that when a rider should fall the elastic is pulled off the stirrup and the rider's boot freed.

The Peacock design has an open and unprotected hook at the top of the stirrup and the bottom of the stirrup to hold the elastic band. Its basic function is to prevent the foot from coming out of the stirrup during normal use, yet breakaway in a fall so as to allow the rider's foot to come completely out of the stirrup preventing entrapment and being dragged by a runaway or panicked horse.

The top stud in the Peacock design is open and unprotected from snagging dangers. The stirrup itself can get hung up on brush, fences, etc. and create a dangerous situation for horse and rider. There have been numerous incidents of this occurring. The bottom stud presents similar issues. The bottom stud protrudes well past the point of usefulness and presents a snagging and hook up hazard. Also, a rider can get hung up by their clothing or laces in the upper or lower peacock hook.

The Peacock design suffers from the risk that exposed studs may become engaged with brush or wire. Passing brush can snag the elastic and remove it from the stirrup.

Several other designs for safety stirrups are known, with similar breakaway concepts but are complex mechanical designs and unaesthetic.

Unfortunately, the world of Western riding has not similarly had the advantage of safety stirrups. Western riding is subject to significant aesthetic restrictions when competing, and visible complex mechanical devices or visible elastic straps do not conform to this aesthetic.

What is needed is a Western safety stirrup that is both functional and conforms to the Western aesthetic.

BRIEF SUMMARY OF THE INVENTION

An important goal of the Western Safety Stirrup is to allow a rider's foot to come free of the stirrup in the event of a fall from their horse so as to prevent entrapment and the subsequent dragging and resultant injury caused by the foot not being released from the stirrup. This is one of the most common causes of serious injury in horseback riding.

English riders have had a peacock style stirrup since the 1800s. Western riders have had very few options in regard to releasing and/or breakaway stirrups.

There are several significant improvements, advantages and differences in the present invention over the Peacock design. The Peacock version has an open and unprotected hook at the top of the stirrup and the bottom of the stirrup to hold the rubber peacock. The Peacock's basic function is to prevent the foot from coming out of the stirrup during normal use yet breakaway in a fall so as to allow the rider's foot to come completely out of the stirrup preventing entrapment and being dragged by a runaway or panicked horse.

The top hook in the Peaock design is open and unprotected from snagging dangers. The stirrup itself can get hung up on brush, fences, etc. and create a dangerous situation for horse and rider. Also, a rider can get hung up by their clothing or laces in the upper or lower peacock hook.

The present invention addresses this issue by recessing the upper attachment point of the elastic into the body of the stirrup. This recessed attachment prevents hang ups on brush, fences, obstacles, clothing, laces, etc.

The bottom attachment presents similar issues as the top hook on the Peacock design. The bottom attachment protrudes well past the point of usefulness and presents a snagging hazard.

The present invention has a smooth and more compact profile to the bottom attachment that is completely encompassed by a leather attachment strap as well as covered by a sturdy leather keeper flap. This shape presents a much lower profile and is less likely to be a snagging up hazard. The leather strap that connects the peacock to the stirrup is designed to completely fill the depth of the attachment knob so the knob itself does not present a flap surface available to snag or hook a passing object, clothing, etc. It also angles down toward the ground at an angle rather than straight out so even if the peacock and leather strap were missing, the likelihood of snagging is greatly diminished. The leather keeper further protects the attachment point by completely covering it from contact with passing obstacles, clothing, etc.

The exposed elastic of the Peacock design also gets caught on brush, fences, rails, etc. and gets ripped off. This makes the hooking and snagging hazard more likely. Without the elastic in place, the upper and lower attachment points are now totally exposed and much more likely to get snagged or hooked on brush, clothing, etc. With the elastic side missing, the entire stirrup now becomes a large hook shape that represents a hazard in and of itself!

The present invention addresses this problem by means of a leather keeper flap that completely covers the elastic and elastic attachment points and creates a barrier to foreign objects getting caught up by the stirrup body. The keeper is connected at the top with the same bolt used to attach the stirrup to the stirrup leathers. This flap is securely fastened at the top but the bottom floats so if a rider falls, the elastic pops off and the keeper flap opens from the bottom and allows the rider's foot to come free of the stirrup.

The keeper flap covers the entire outside aspect of the stirrup. It starts above the top peacock recessed attachment point and extends down over the entire peacock to the bottom of the stirrup body. It protects the upper point, the elastic itself and the lower elastic attachment point. It prevents the elastic from being torn off by brush, etc. as well as protects the stirrup body itself from becoming a hooking hazard if the elastic is missing or gets ejected in a fall.

The keeper also functions as a fairlead device. Any foreign object coming into contact with the stirrup is deflected away from the peacock and the stirrup body by the smooth surface of the keeper flap. The shape and design will direct forces downward and away from the stirrup. The overall effects of the unique keeper design are multifaceted.

The leather keeper also presents an expressive aesthetic element. It maintains a western look that matches and compliments traditional western tack. It may be stamped and carved with western motifs as well as monogramed.

BRIEF DESCRIPTION OF THE DRAWINGS

These and other features and advantages of the present invention will be better understood by reading the following detailed description, taken together with the drawings wherein.

Like reference numbers and designations in the various drawings indicate like elements.

DETAILED DESCRIPTION OF THE INVENTION

Figure 1:
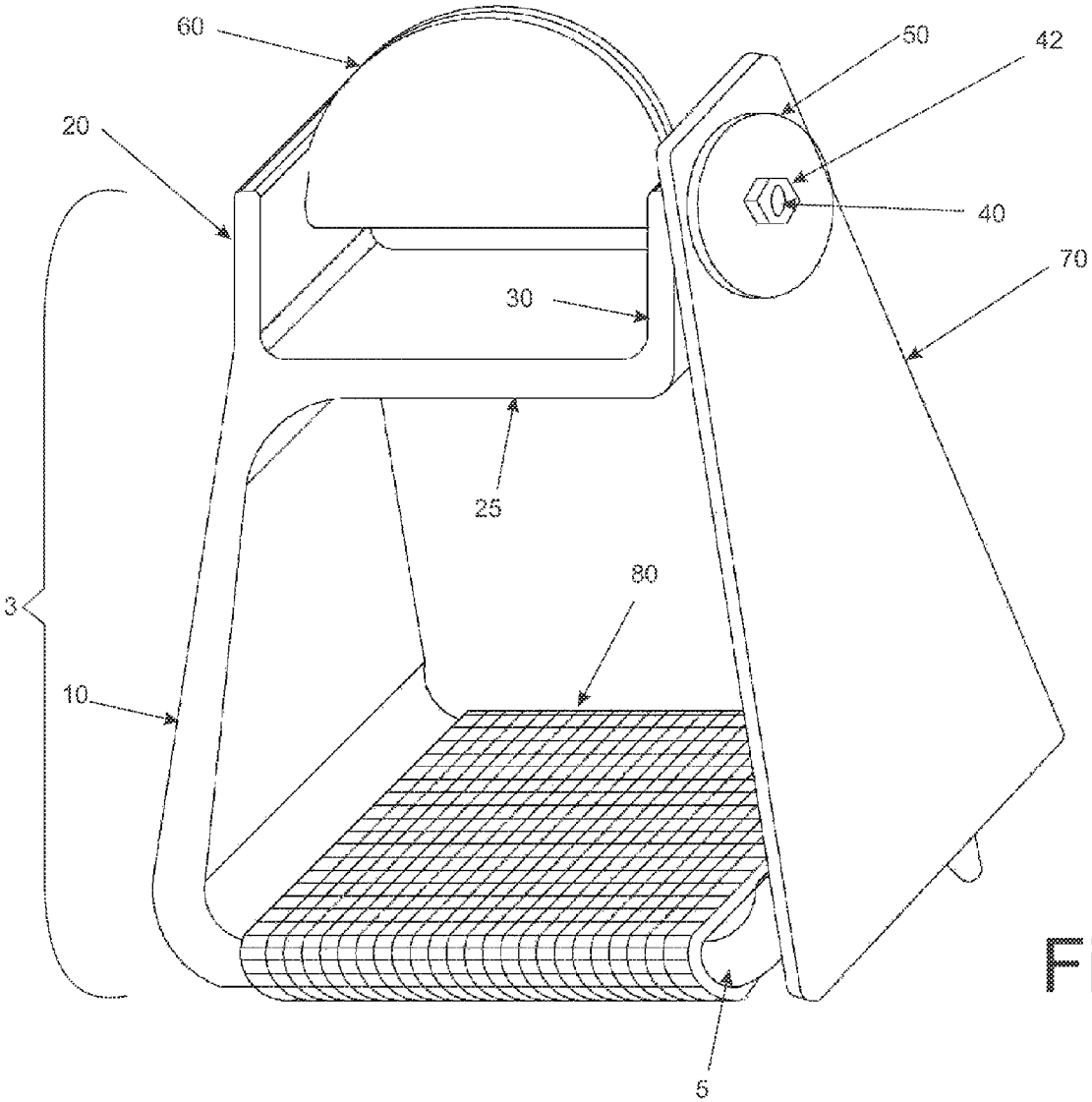
FIG. 1 is a front oblique view of a fully assembled Western safety stirrup with cover flap.

Referring to FIG. 1, a fully assembled Western safety stirrup is shown in an oblique view. The stirrup comprises a body 3 comprising a tread 5, a lower inner side 10, an upper inner side 20, an upper base 25 and an upper outer side 30. The upper end of the inner side 10 blends into a generally channel shaped upper portion comprised of an inner upper side 20, a base 25 and an outer upper side 30. As shown in FIG. 1, the tread is nearly entirely covered by a nonskid tread material 80.

The body 3 is beneficially made from a single piece of material, such as a cast metal. In a preferred embodiment, it is made of cast aluminum. Other materials may also be used, such as wood and leather. However, aluminum affords strength, durability and light weight.

The stirrup may be attached to a saddle by wrapping a stirrup leather (not shown) around the bolt wear leather 60. The bolt wear leather is supported by a bolt 40 only the end of which is visible in this view. The bolt 40 is held in place by a nut 42. A roller pipe (not shown) may be placed around the bolt 42 reduce wear.

A leather keeper flap 70 over the outside of the stirrup is held in place by the bolt 40 and nut 42 and a fender washer 50. The keeper flap 70 covers the safety mechanism described below. The keeper flap 70 is both utilitarian and aesthetic. The keeper flap covers the stirrup safety device keeping it from being tangled in brush and the like, and is also more in keeping with the Western aesthetic.

Figure 2:
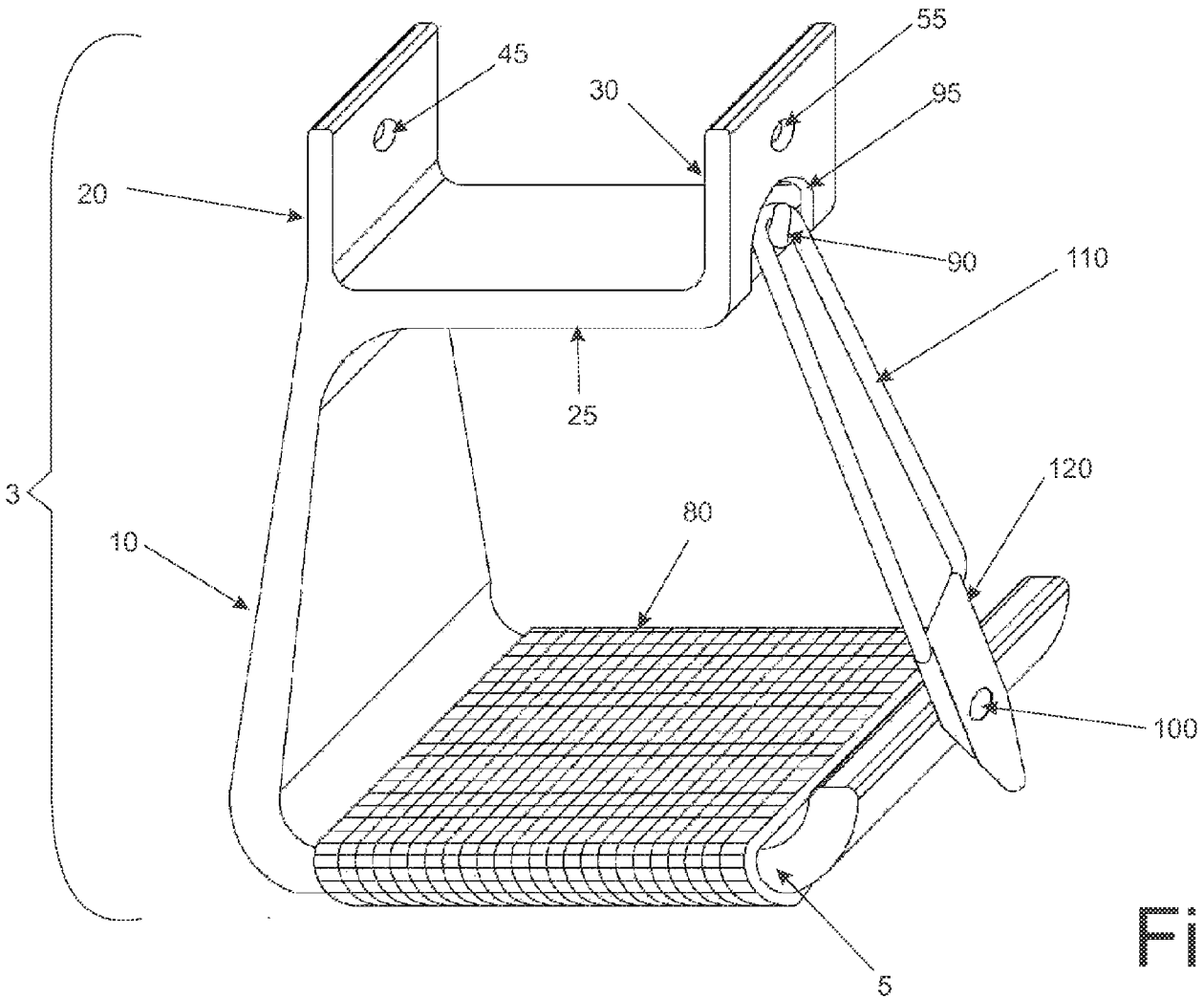
FIG. 2 is a front oblique view of a partially assembled Western safety stirrup.

FIG. 2 is the same view of a Western safety stirrup with the keeper flap 70 removed as well as the bolt wear leather 60, nut 42 and fender washer 50 removed for clarity. The inner upper side 20 and outer upper side 30 are shown being pierced by two holes 45, and 55 respectively. These holes 45 and 55 are used to support the bolt 40.

Now visible because the keeper flap 70 has been removed, an upper stud 90 and a lower stud 100 are seen with an elastic member 110 stretched between them. In the embodiment shown, there is a leather wrap 120, with holes 125 in each end, wrapped around the elastic member 110, and the holes 125 pressed over the lower stud 100. The upper stud 90 is recessed below the outer surface of the upper outer side, placed within a cut out 95. The upper outer side may have grooves cut into it to permit passage of the elastic member. The upper stud 90 being recessed below the surface of the upper outer side, it is less likely to be entangled in brush or caught on a writer's clothing. Similarly, the lower stud 100 is flattened, has a low profile and is angled downward, so that with the leather wrap 120 installed the lower stud is also protected from catching and clothing or brush. When covered by the keeper flap 70, not shown in this view, both studs 90 and 100 are further protected and almost impossible to entangle either brush or clothing. This is a substantial improvement over the Peacock design.

In use, a rider inserts their foot in the stirrup. The nonskid mat helps hold the foot in place. The combination of the keeper flap 70 and the elastic member 110 serve to form the outer side of the stirrup. In a fall, the foot applies lateral pressure on the elastic member 110, and if sufficient pressure is applied, the member disengages from the upper stud in the lower stud 100. This opens the outer side of the stirrup allows the foot to be released.

The keeper flap 70 is securely fastened at the top but the bottom floats so if a rider falls, the elastic member 110 pops off and the flap opens from the bottom and allows the rider's foot to come free of the stirrup. The keeper flap covers the entire outside aspect of the stirrup.

Western riders have an historic resistance to safety elements that detract from traditional appearances and Aesthetics in western tack. The leather keeper maintains the western aesthetic so important to most western riders. This unique feature encourages the traditional western horseman to utilize this important piece of safety equipment.

Figure 3:
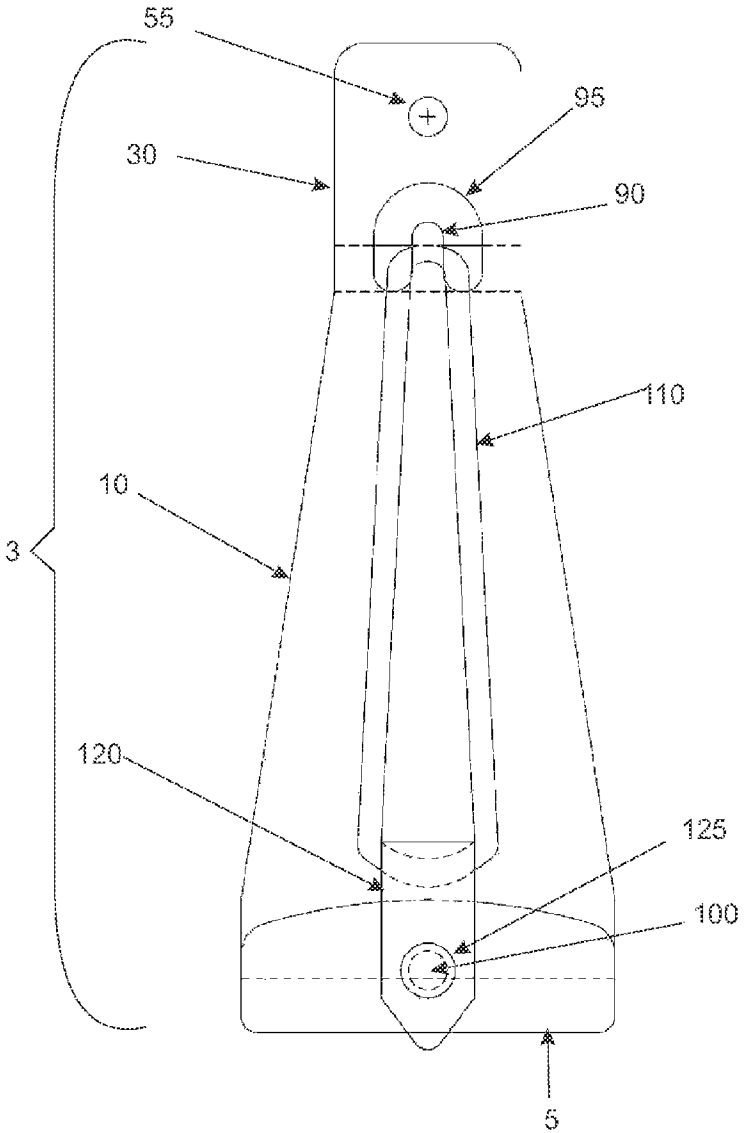
FIG. 3 is a side orthogonal view of a Western safety stirrup.

FIG. 3 is an outer side view of the Western safety stirrup previously described. In this view, the keeper flap 70 has been removed.

Figure 4:
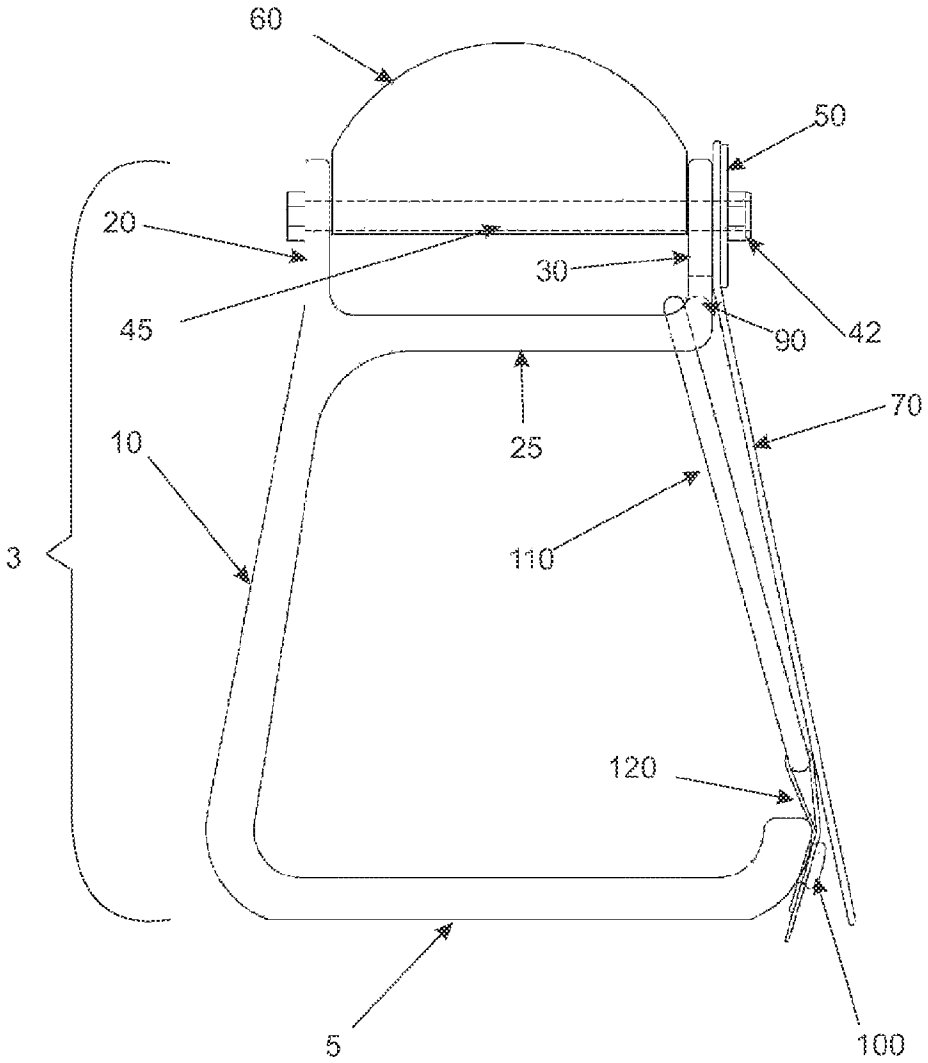
FIG. 4 is a front orthogonal view of a Western safety stirrup with cover flap.
Figure 5:
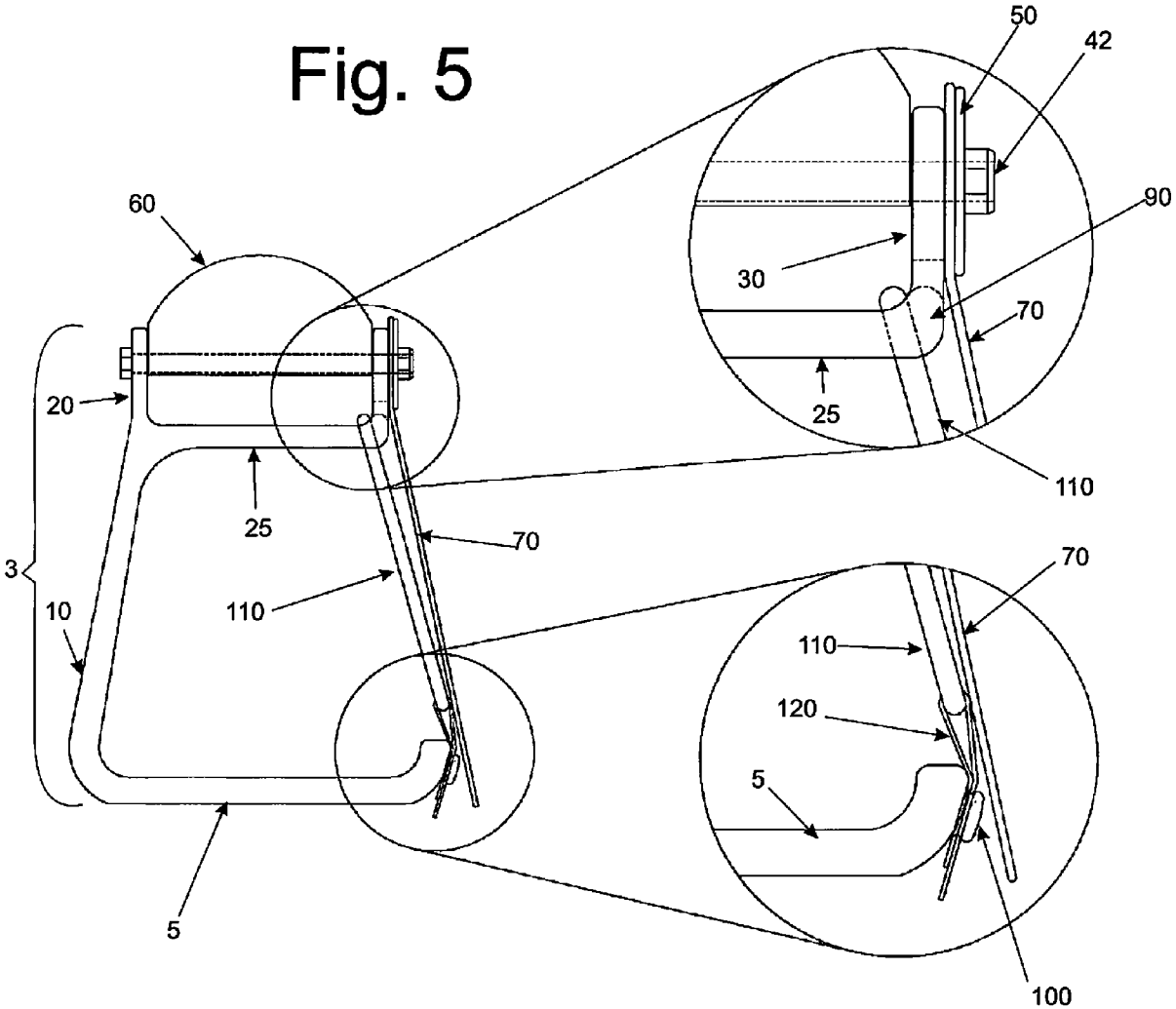
FIG. 5 is an close up view of the upper and lower attachment points of an elastic side of a Western safety stirrup.
Figure 6:
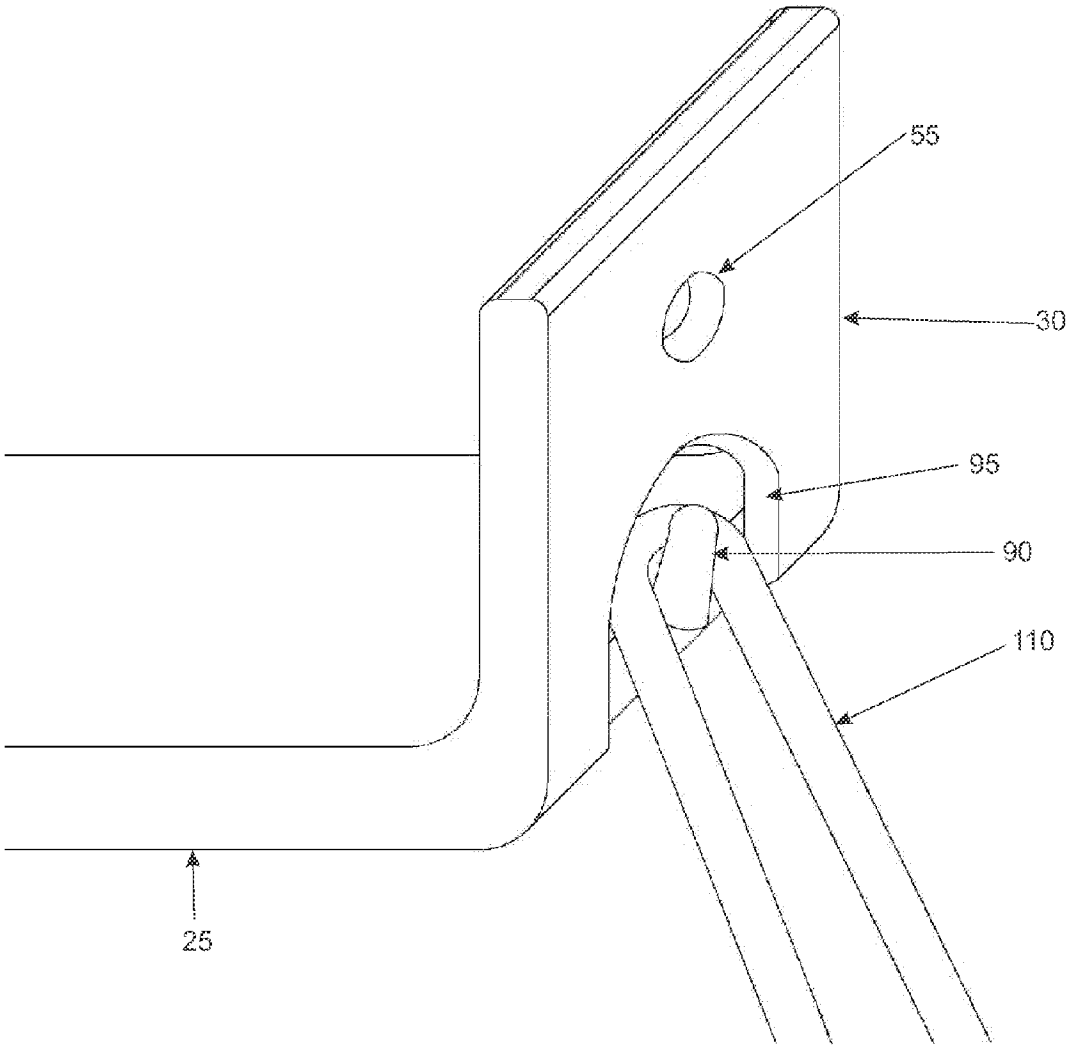
FIG. 6 is a detailed view of the upper attachment point of elastic side and a portion of the side elastic of a Western safety stirrup.

FIG. 4 is a front orthogonal view of a Western safety stirrup. In this view, the hidden lines show a roller 45 slid over the bolt 40 in order to lessen wear on the bolt wear leather. As can be seen, the keeper flap 70 covers the elastic member. As can also be seen, both the upper stud 90 and lower stud 100 are out of the way of catching brush and/or clothing. This can be even better seen in FIG. 5, which shows close up views of the upper stud 90 and lower stud 100 in use. FIG. 6 is another very close up view showing how the upper stud is recessed below the surface of the outer upper side 30, contained within a cut out 95 in the upper outer edge 30.

The invention has been described in terms of particular embodiments. Other embodiments are within the scope of the following claims. Modifications and substitutions by one of ordinary skill in the art are considered to be within the scope of the present invention, which is not to be limited except by the following claims.

The invention claimed is:

1. A Western safety stirrup adapted to be attached to a saddle stirrup strap and to receive a rider's foot, said stirrup comprising:

a body, said body formed of a single piece, comprising:

a tread area, said tread area having an inner side and an outer side;

an inner side area, said inner side area having a lower end and an upper end, said lower end attached to and substantially perpendicular to said tread area inner side;

a top area, said top area being generally channel shaped and open at a top, with an inner side and an outer side and a bottom side; said inner side and said bottom side of said top area attached and perpendicular to said upper end of said inner side area; said bottom side of said top area having an outer edge;

said top area inner side and said top area outer side each comprising a hole running parallel to said top area bottom side and sized to accept a bolt; said top area outer side further comprising a pierced portion below said hole extending to said outer edge of said bottom side; said pierced portion comprising an upper stud within said pierced portion and extending upwardly from said outer edge of said bottom side;

said tread area outer side further comprising a lower stud protruding downwardly from said tread area outer side;

said safety stirrup further comprising a breakaway outer side comprising an elastic loop, said elastic loop attached at one end to said upper stud and at another end to said lower stud.

2. The Western safety stirrup of claim 1, further comprising a flexible keeper flap covering an outer side of said safety stirrup; said keeper flap having a hole at one end adapted to accept the bolt;

and a fender washer;

the bolt and a nut;

wherein said bolt is installed threaded end first through the inner side of said top area inner side hole, then through said top area outer side hole, then through said keeper flap hole, then through said fender washer and then into said nut.

3. The Western safety stirrup of claim 2 in which said keeper flap and said fender washer are made from leather.

4. The Western safety stirrup of claim 2 wherein the keeper flap is trapezoidally shaped.

5. The Western safety stirrup of claim 1 further comprising a flexible wrap comprising a hole at each end adapted to fit over said lower stud, wherein said leather wrap is looped around said elastic member and said flexible wrap holes placed over said lower stud thereby attaching said elastic member to said lower stud.

6. The Western safety stirrup of claim 5 wherein said lower stud is flattened and sized to be only slightly thicker than twice the thickness of the flexible wrap.

7. The Western safety stirrup of claim 5 wherein the flexible wrap is made from leather.

8. The Western safety stirrup of claim 1 wherein said body is made from metal.

9. The Western safety stirrup of claim 8 wherein the metal is cast aluminum.

10. The Western safety stirrup of claim 1 wherein said pierced portion comprises two grooves on said outer edge of said bottom side, said two grooves are adapted to allow passage of said elastic loop.

* * * * *